US011585502B2

(12) United States Patent
Van Bommel et al.

(10) Patent No.: US 11,585,502 B2
(45) Date of Patent: Feb. 21, 2023

(54) LIGHT EMITTING DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL); Robert Jacob Pet, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/426,468

(22) PCT Filed: Mar. 10, 2020

(86) PCT No.: PCT/EP2020/056308
§ 371 (c)(1),
(2) Date: Jul. 28, 2021

(87) PCT Pub. No.: WO2020/182793
PCT Pub. Date: Sep. 17, 2020

(65) Prior Publication Data

US 2022/0099260 A1 Mar. 31, 2022

(30) Foreign Application Priority Data

Mar. 14, 2019 (EP) ..... 19162916

(51) Int. Cl.
*F21S 8/08* (2006.01)
*F21Y 115/10* (2016.01)

(52) U.S. Cl.
CPC ..... *F21S 8/086* (2013.01); *F21Y 2115/10* (2016.08)

(58) Field of Classification Search
CPC ..... F21S 8/086
See application file for complete search history.

(56) References Cited

U.S. PATENT DOCUMENTS

| | | | | |
|---|---|---|---|---|
| 1,258,007 | A | 3/1918 | Hess | |
| 6,923,559 | B2 | 8/2005 | Ng et al. | |
| 9,412,907 | B1 | 8/2016 | Place et al. | |
| 2012/0068198 | A1 | 3/2012 | Andrews et al. | |
| 2012/0069198 | A1 | 3/2012 | Steinberg et al. | |
| 2013/0286638 | A1* | 10/2013 | Wang | F21V 17/08 362/249.02 |

(Continued)

FOREIGN PATENT DOCUMENTS

| | | | |
|---|---|---|---|
| CN | 203703659 | U | 7/2014 |
| WO | 2013055650 | A1 | 4/2013 |
| WO | 2016052025 | A1 | 4/2016 |

*Primary Examiner* — Andrew J Coughlin
*Assistant Examiner* — Nathaniel J Lee

(57) ABSTRACT

A light emitting device (3) comprising an array of light emitting diodes (LEDs) (301-317), said array of LEDs comprising a plurality of LEDs (61-69), a center (31), an perimeter (32) and a first axis (X) extending through the center and transverse to the outer circumferential edge, where each LED of the array of LEDs comprises a size and a shape, where the plurality of LEDs is arranged on a plurality of lines (L) extending in a direction 5 from a point on the first axis (X) towards the outer circumferential edge (32), two or more LEDs of the plurality of LEDs being arranged on each line, and where the two or more LEDs on each line are arranged such that at least one gradient in the size of the LEDs and/or the shape of the LEDs is provided in a direction along said line.

15 Claims, 10 Drawing Sheets

(56) References Cited

U.S. PATENT DOCUMENTS

| | | | | |
|---|---|---|---|---|
| 2014/0321155 | A1 | 10/2014 | Rho | |
| 2015/0009698 | A1* | 1/2015 | Han | F21S 41/39 362/517 |
| 2015/0146448 | A1* | 5/2015 | Han | F21S 41/155 362/520 |
| 2017/0130909 | A1 | 5/2017 | Yeon et al. | |
| 2018/0302963 | A1* | 10/2018 | Fu | H05B 45/48 |

* cited by examiner

LIGHT EMITTING DEVICE

CROSS-REFERENCE TO PRIOR APPLICATIONS

This application is the U.S. National Phase application under 35 U.S.C. § 371 of International Application No. PCT/EP2020/056308, filed on Mar. 10, 2020, which claims the benefit of European Patent Application No. 19162916.1, filed on Mar. 14, 2019. These applications are hereby incorporated by reference herein.

FIELD OF THE INVENTION

The invention relates to light emitting devices of the type comprising a transparent cover forming a light exit window of the lighting device and an array of light emitting diodes (LEDs).

BACKGROUND OF THE INVENTION

In many lighting applications such as e.g. street lighting, the light exit window of the luminaire is completely transparent such that the individual LEDs in the light source can be easily recognized. A transparent cover often is applied to enable beam shaping. It appears that light sources which consists of orthogonally arranged LEDs (rows and columns) provide discomfort glare. The regular arrangement of light sources appears to have a distracting effect, which is experienced as undesirable. It appears that people tend to complain about the glare and the pixilation of LED luminaires.

US 2014/0321155 A1 describes one possible solution according to which a lighting device comprises a light source means and a light guide plate, and the light guide plate is provided with a scattering pattern formed on a surface of the light guide plate such that the distribution of light emitted from the light guide plate is maintained uniform so as to increase the light emitting efficiency. The light source means includes a plurality of LEDs disposed in a hole of the light guide plate to emit light in direction of a light incident section of the light guide plate. Therefore, the light emitting surfaces face towards the said light incident section.

However, this solution necessitates a light guide with a complex structure, and is thus complex and expensive in production.

It is thus desired to provide an alternative light emitting device which at least partly counteracts or obviates one or more of the above-described drawbacks of the known prior art light emitting devices, and which in particular reduces or even eliminates glare and the discomforts associated with glare.

SUMMARY OF THE INVENTION

It is an object of the present invention to overcome this problem, and to provide an alternative light emitting device which at least partly counteracts or obviates one or more of the above-described drawbacks of the known prior art light emitting devices, and which in particular reduces or even eliminates glare and the discomforts associated with glare.

According to a first aspect of the invention, this and other objects are achieved by means of a light emitting device comprising an array of light emitting diodes (LEDs), said array of LEDs comprising a plurality of LEDs, a center, a perimeter (which may also be referred to as outer circumferential edge) and a first axis extending through the center and transverse to the perimeter, where each LED of the array of LEDs comprises a size and a shape, where the plurality of LEDs is arranged on a plurality of lines extending in a direction from a point on the first axis towards the perimeter, two or more LEDs of the plurality of LEDs being arranged on each line, and where the two or more LEDs on each line are arranged such that at least one gradient in the size of the LEDs is provided in a direction along said line.

More specifically, the light emitting device comprises a two-dimensional rectangular array of light emitting diodes (LEDs), said array of LEDs comprising a plurality of LEDs, a center, a perimeter and a first axis (X) extending in a first direction of the rectangular array through said, wherein each LED of the two-dimensional array of LEDs comprises a size and a shape, wherein the plurality of LEDs is arranged on a plurality of lines (L) extending in a second direction orthogonally to said first direction from a point on the first axis (X) towards the perimeter, two or more LEDs of the plurality of LEDs being arranged on each line (L), and wherein the two or more LEDs on each line (L) are arranged such that at least one gradient in the size and/or shape of the LEDs is provided in a direction along each line, and the LEDs on the first axis (X) are the same in size and shape.

Thereby, and in particular by arranging the plurality of LEDs on a plurality of lines extending in a direction from a point on the first axis towards the perimeter, such that two or more LEDs of the plurality of LEDs are arranged on each line, and such that the two or more LEDs on each line are arranged such that at least one gradient in the size of the LEDs is provided in a direction along said line, the LEDs are arranged in a halftone configuration. This provides for a light emitting device with which glare is reduced considerably without the need for light guide plates or other optics in front of the array of LEDs.

Such a light emitting device has a very simple construction, and is cheap to produce. Furthermore, a lamp or a luminaire comprising such a light emitting device is not only visually appealing in the on state, but also in the off state.

In an embodiment, the pitch measured as the distance between centers of mutually adjacent LEDs on a line is constant.

By keeping the pitch constant, a light emitting device with which a gradual decrease in brightness may be obtained is provided for.

In an embodiment, the pitch measured as the distance between centers of mutually adjacent LEDs on a line is decreasing with a decreasing size of the LEDs. In other words, the ratio between pitch and size is kept constant.

Thereby, a light emitting device is provided with which a uniform, high brightness may be obtained.

In an embodiment, the pitch measured as the distance between centers of mutually adjacent LEDs on a line is increasing with a decreasing size of the LEDs. Thereby, a light emitting device is provided with which a decrease, and even a steep decrease, in brightness may be obtained.

In an embodiment, the at least one gradient in size of the LEDs is an increase, a decrease or a combination of an increase and a decrease.

Thereby, a light emitting device is provided with which further possibilities for customizing the light output are enabled.

In an embodiment, the gradient in the size of the LEDs is obtained by providing the two or more LEDs on each line with different shapes.

Thereby, still further possibilities for customizing the light output are enabled while still achieving the above-mentioned advantages.

In an embodiment, the direction in which the lines extend is any one of a linear direction, a radial direction, a diametrical direction and a direction curving from said center towards said perimeter.

Thereby, even further possibilities for customizing the light output are enabled while still achieving the above-mentioned advantages.

In an embodiment, the light emitting device comprises a plurality of electrically conductive tracks, each electrically conductive track of said plurality of electrically conductive tracks comprise a positive terminal and a negative terminal for connection with a power source, and LEDs of said array of LEDs having the same size are connected to the same one electrically conductive track of said plurality of electrically conductive tracks, and are thus, in operation, driven by the same electrical current.

Thereby LEDs of the same type may be driven with the same and an optimum current. This in turn provides for a light emitting device with which an optimized light output profile may be obtained.

In an embodiment, the light emitting device comprises a plurality of electrically conductive tracks, the electrically conductive tracks of the plurality of electrically conductive tracks comprise a common positive terminal and one negative terminal each, and LEDs of said array of LEDs having the same size are connected to the same one electrically conductive track of said plurality of electrically conductive tracks such that, in operation, the total luminous flux of the LEDs driven by each electrically conductive track of said plurality of electrically conductive tracks is the same.

Thereby the different types of LEDs may be driven in such a way that the intensity as a function of the radius or diameter of the transparent cover is kept constant. This in turn provides for a light emitting device with which a homogeneous light output profile may be obtained.

In an embodiment, the light emitting device comprises an array of optical elements, and each optical element of the array of optical elements is associated with an LED of the array of LEDs, and each optical element of the array of optical elements is configured to enable shaping the light emitted by the LED with which the optical element is associated.

This provides for a light emitting device with which the visibility of the individual LEDs when seen from specific angle(s) of view is improved which in turn provides for a greater versatility in terms of light output patterns achievable.

In an embodiment, the light emitting device comprises an array of optical elements, wherein each optical element of the array of optical elements is associated with an LED of the array of LEDs, and wherein the size of each optical element of the array of optical elements is configured to correlate with the size of the LED with which the optical element is associated.

This provides for a light emitting device with which the size of each optical element correlates with the observed size of the LED with which the optical element is associated. This in turn provides for an even greater versatility in terms of light output patterns achievable.

In an embodiment, the light emitting device further comprises an array of optical elements, each optical element of the array of optical elements is associated with an LED of the array of LEDs, and the optical elements of the array of optical elements on each line are arranged such that at least one gradient in size of the optical elements is provided.

Thereby a light emitting device is provided with which a light output giving the viewer an impression of halftone while still enabling a very simple drive control and electronics of the LEDs. Furthermore, as an observer of such a light emitting device will perceive the LEDs on each line as having a gradient in size, it is in this embodiment in principle possible to omit providing the LEDs on each line with different physical sizes.

In an embodiment, the number of LEDs increases with decreasing size of the LEDs.

Thereby a light emitting device is provided with which a light output having a high brightness may be obtained.

In an embodiment, a second axis, Y, is defined as extending perpendicular to the first axis, X, through said center and transverse to said perimeter, and the gradient in the size of the LEDs, and where appropriate the gradient in size of the optical elements, is symmetrical around at least one of the first axis and the second axis.

In an embodiment, the gradient in the size of the LEDs, and where appropriate the gradient in the size of the optical elements, is symmetrical around both the first axis and the second axis.

These two embodiments provide for a light emitting device with which an even greater versatility in terms of light output patterns achievable.

In an embodiment, the lines of LEDs of the array of LEDs are arranged in any one of a quadratic configuration, a rectangular configuration, a circular configuration and a spiraling configuration.

In a further embodiment the LEDs of the array of LEDs are tilted around their optical axis. The angle of tilt may be any suitable angle, such as but not limited to 45 degrees.

These two embodiments provide for a light emitting device with which an even greater versatility in terms of light output patterns achievable, while still achieving the initially mentioned objects.

The invention furthermore, in a second aspect, concerns a lamp, a luminaire or a lighting fixture comprising a light emitting device according to the invention.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
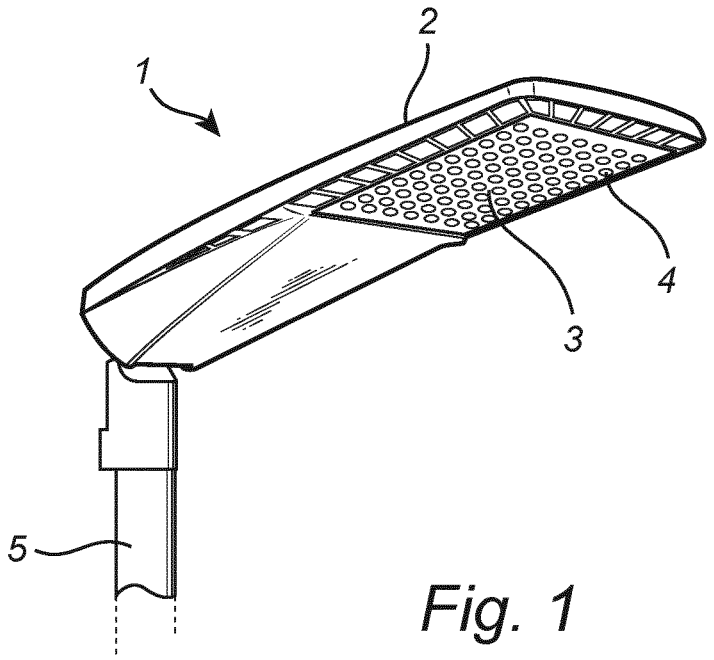
FIG. 1 shows a schematic perspective view of a lighting fixture comprising a light emitting device according to the invention with an array of LEDs.

FIG. 1 shows by way of example a schematic perspective view of a lighting fixture 1 comprising a light emitting device 3 according to the invention with an array of light emitting diodes (LEDs). The LEDs are arranged on a substrate, typically being a printed circuit board (PCB). The lighting fixture 1 further comprises a housing 2 housing the light emitting device 3. The light emitting device 3 comprises a transparent cover 4 forming a light exit surface of the lighting fixture 1. In other embodiments, the light emitting device may be provided without a cover 4. The lighting fixture 1 may optionally be arranged on a pole 5, a stand or the like, such as to from e.g. a lamp or a street lighting luminaire.

The LEDs of the array of LEDs are configured to emit light. The light emitted by the LEDs may be white light. The white light may be within 15 SDCM (Standard Deviation Color Matching) from the BBL (Black Body Line), within 10 SDCM from the BBL, or within 7 SDCM from the BBL. The white light may have a CRI (Color Rendering Index) of at least 70, of at least 80, or of at least 85. All LEDs of the array of LEDs may provide the same color point and/or color temperature. The size of the LEDs may be in the range from 0.1 to 3 cm.

The LEDs of the array of LEDs may be phosphor converted LEDs. The phosphor converted LEDs may be UV and/or blue LEDs arranged with a green/yellow and red luminescent material e.g. an inorganic phosphor and/or quantum dots/rods. Each LED may comprise one or more solid state emitters. For instance, each LED may comprise an array of solid state emitters. The array of solid state emitters may be covered with a luminescent material. The array of solid state emitters has the appearance of a single source, i.e. the solid state emitters are arranged closely together. For example, the array of solid state emitters may be a chip on board (COB) LED. It may also be another LED package or just a normal LED (not in a package). Also, all LEDs may provide the same CCT (Correlated Color Temperature).

Figure 2:
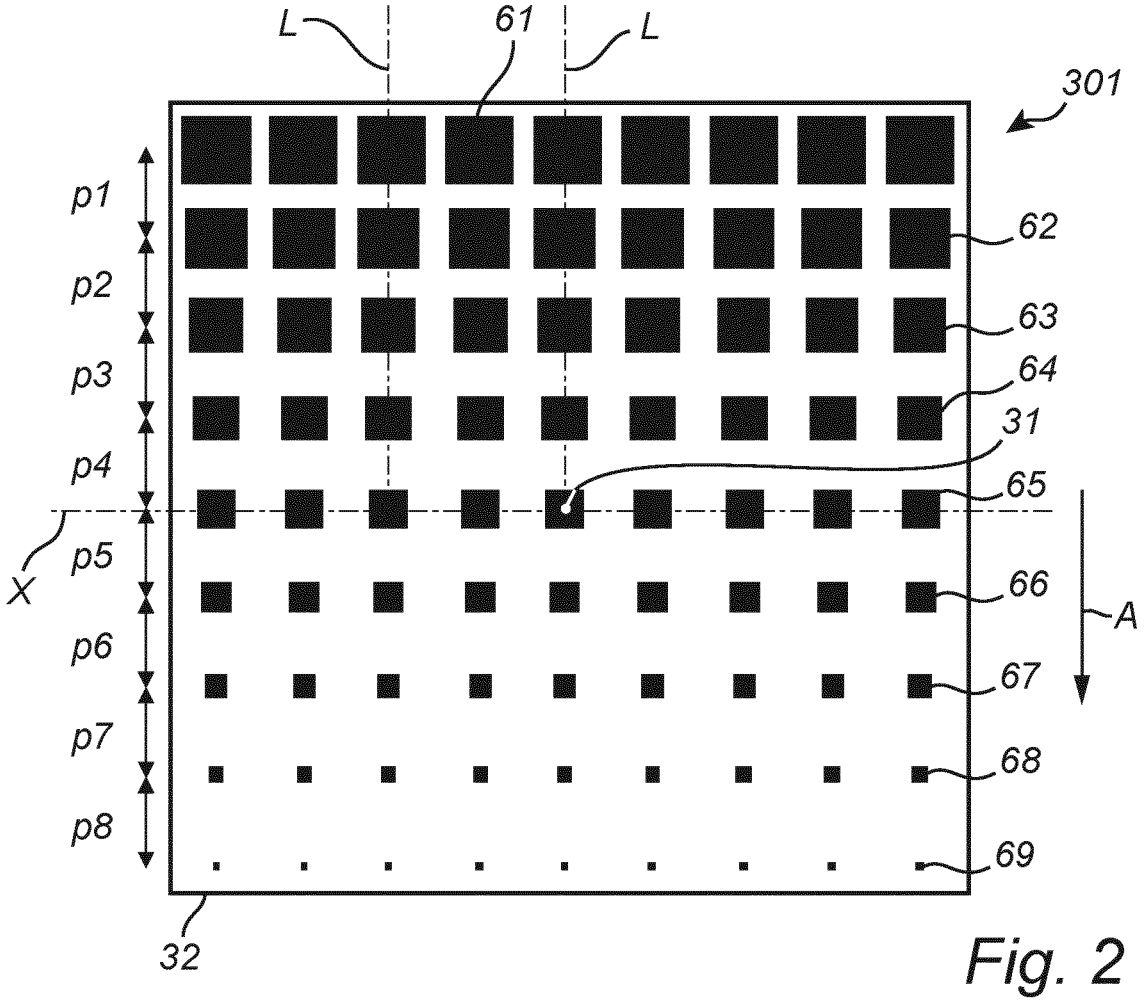
FIG. 2 shows a schematic top view of a first embodiment of an array of LEDs of a light emitting device according to the invention.

FIG. 2 shows a schematic top view of a first embodiment of an array of LEDs 301 of a light emitting device 3 according to the invention.

With reference to FIG. 2, generally, and irrespective of the embodiment, a two-dimensional rectangular array of LEDs 301 of a light emitting device 3 according to the invention comprises a plurality of LEDs 61-69, a center 31, an outer perimeter (or circumferential edge) 32 and an axis X extending in a first direction of the rectangular array through the center 31 and transverse to the perimeter 32. In some embodiments the axis X may extend perpendicular to the perimeter 32. The plurality of LEDs 61-69 is arranged on a number of lines L extending in a second direction of the rectangular array perpendicular to said first direction from a point on the axis X towards the perimeter 32 of the array of LEDs 301. The lines L may, but need not, extend through the center 31 of the array of LEDs. Each line L of LEDs comprises a plurality of LEDs 61-69 of the array of LEDs 301. Each LED of the array of LEDs 301 comprises a size and a shape. The LEDs 61-69 on each line L are arranged such that a gradient in size of the LEDs 61-69 is provided. In some embodiments, the gradient in size of the LEDs 61-69 is obtained by providing the two or more LEDs on each line with different shapes. On each line L there may generally be arranged two or more LEDs, such as at least 3, at least 4 or at least 5 LEDs, for example 7 or 10 LEDs. Preferably, the LEDs that are positioned on the axis X are all the same in size and shape.

The array of LEDs of a light emitting device according to the invention may generally comprise any feasible number of LEDs. The array of LEDs may also comprise any feasible number of lines of LEDs. For example, the array of LEDs may comprise at least 5 lines of LEDs, at least 7 lines of LEDs, at least 8 lines of LEDs, or even at least 10 lines of LEDs. The LEDs may emit light of any feasible color. The LEDs may further emit light of the same color, or of two or more different colors.

In the embodiment shown in FIG. 2 the array of LEDs is square in shape and comprises 9×9 LEDs and thus nine rows and nine columns of LEDs. A gradient in the size of the LEDs 61-69 is provided such that the size of the LEDs 61-69 decrease in the direction A. Thus, as the nine vertical rows extend in parallel with the direction A, the nine vertical rows in this embodiment correspond to the lines L described above. The lines L of the embodiment of FIG. 2 extend in a linear direction. The shape of the LEDs is identical throughout the array 301. Furthermore, the pitch p1-p8 is also constant.

It is noted that generally and irrespective of the embodiment, the pitch p is measured as the distance between centers of mutually adjacent LEDs in a line L. The pitch p may be in the range from 0.3 to 10 cm.

Figure 3:
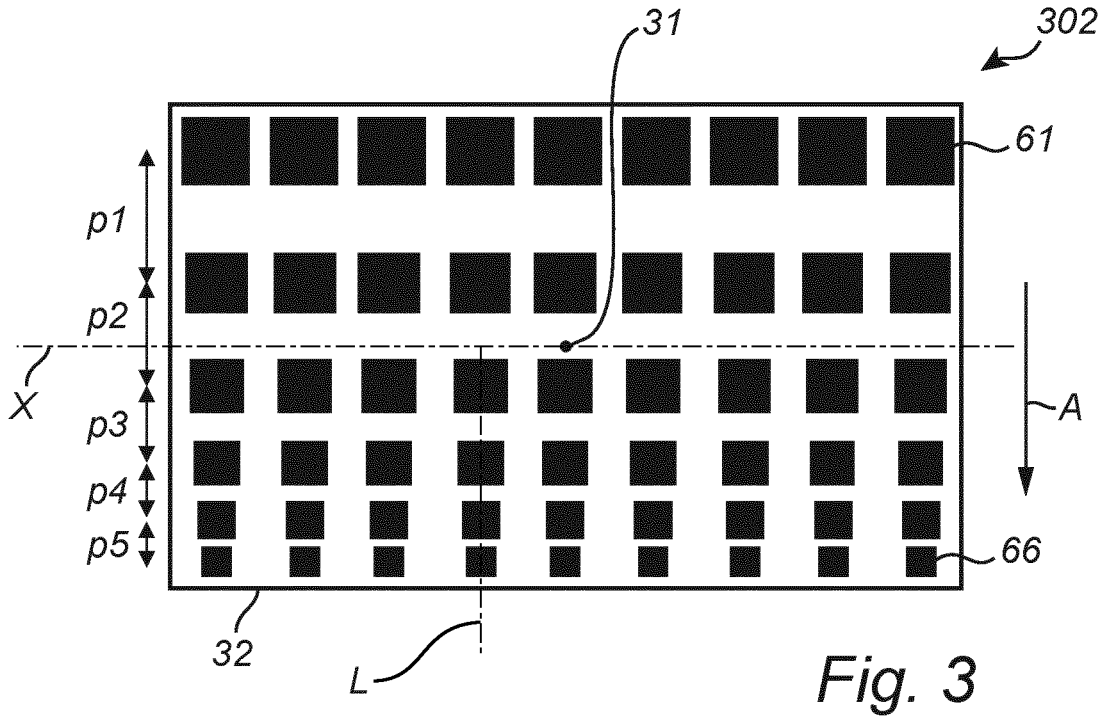
FIG. 3 shows a schematic top view of a second embodiment of an array of LEDs of a light emitting device according to the invention.

FIG. 3 shows a schematic top view of a second embodiment of an array of LEDs 302 of a light emitting device 3 according to the invention. The array of LEDs 302 differs from that described with reference to FIG. 2 in virtue of the following features. The array of LEDs 302 comprises 9×6 LEDs. The array of LEDs 302 is rectangular in shape. The LEDs 61-66 are arranged such that the pitch p1-p5 has a gradient and decreases in the direction A.

Figure 4:
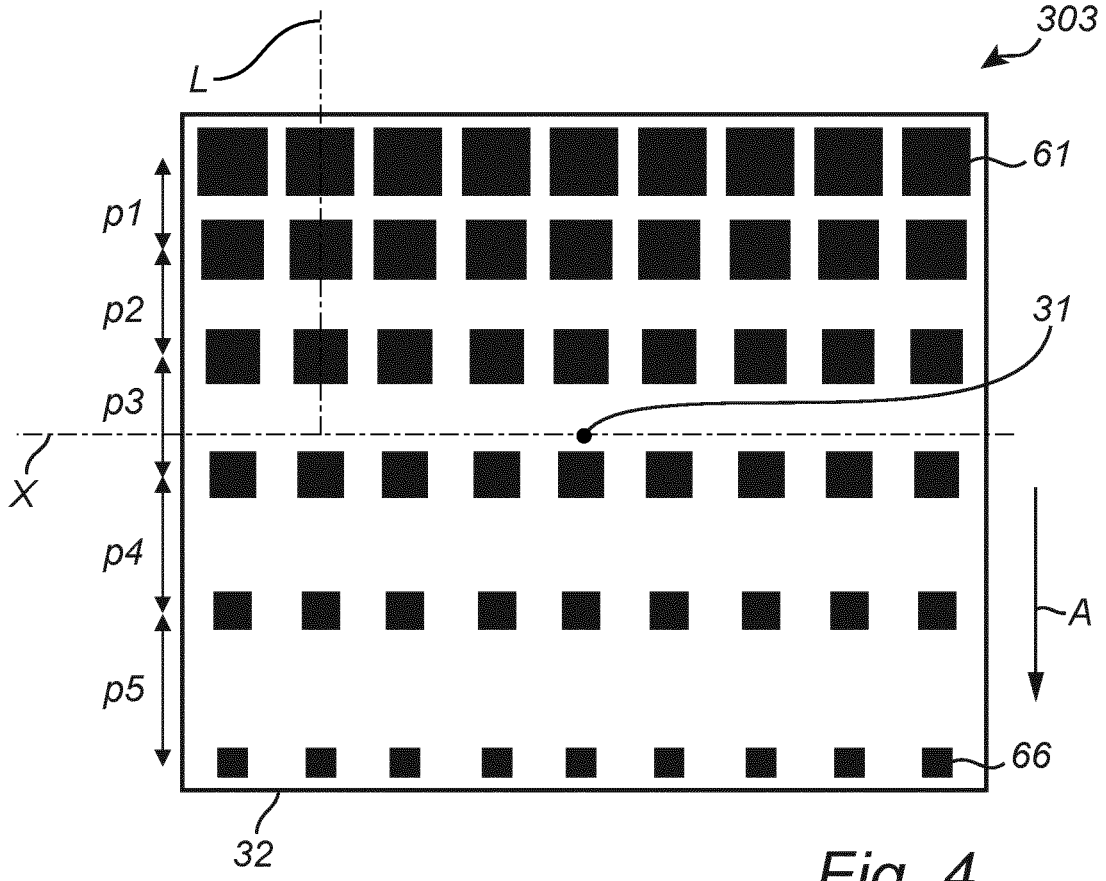
FIG. 4 shows a schematic top view of a third embodiment of an array of LEDs of a light emitting device according to the invention.

FIG. 4 shows a schematic top view of a third embodiment of an array of LEDs 303 of a light emitting device 3 according to the invention. The array of LEDs 303 differs from that described with reference to FIG. 3 in virtue only of that the LEDs 61-66 are arranged such that the pitch p1-p5 has a gradient and increases in the direction A.

Figure 5:
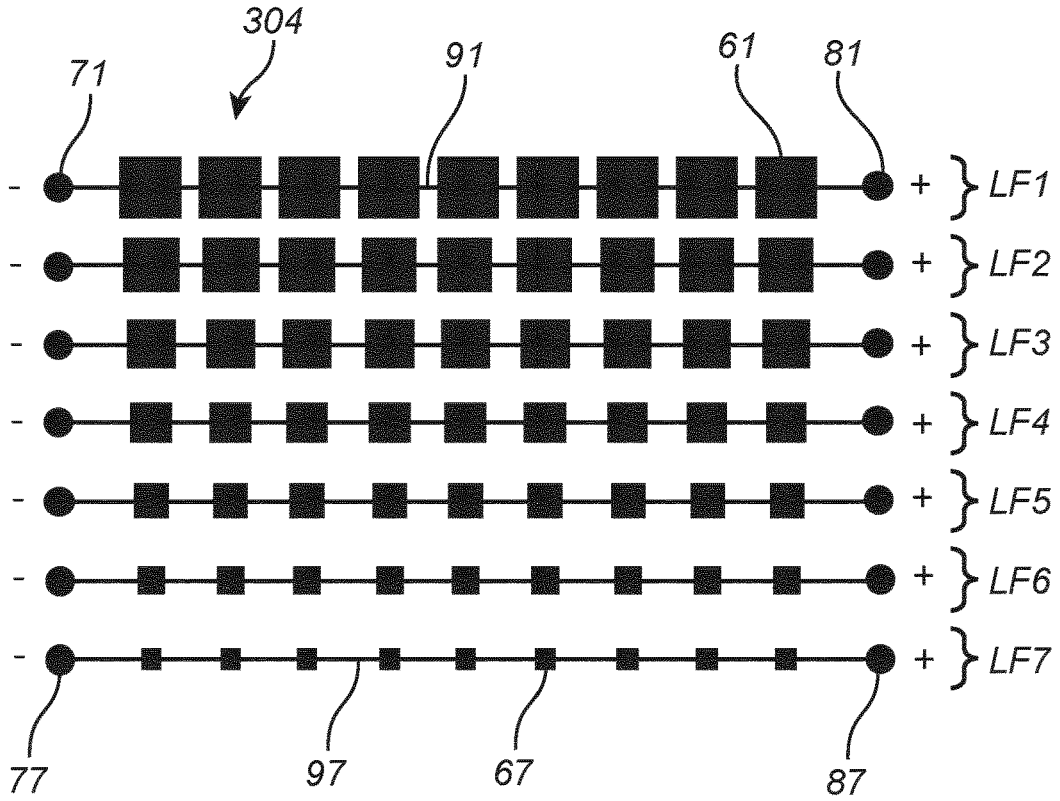
FIG. 5 shows a schematic top view of a fourth embodiment of an array of LEDs of a light emitting device according to the invention and showing an embodiment of electrically conductive tracks powering the LEDs.

FIG. 5 shows a schematic top view of a fourth embodiment of an array of LEDs 304 of a light emitting device 3 according to the invention. The array of LEDs 304 differs from those described in the above with reference to FIGS. 1-4 in virtue of the features that the array of LEDs 304 comprises 9×7 LEDs 61-67.

Furthermore, FIG. 5 shows an embodiment of a plurality of electrically conductive tracks 91-97 powering the LEDs of the array of LEDs 304. The electrically conductive tracks 91-97 are formed on a substrate, such as a PCB. Each electrically conductive track 91-97 of the plurality of electrically conductive tracks comprises a positive terminal 81-87 and a negative terminal 71-77 for connection with a power source. LEDs of the array of LEDs 304 having the same size are connected to the same one electrically conductive track 91-97 of the plurality of electrically conductive tracks. For instance, all LEDs in the upper horizontal row of LEDs on FIG. 4 have the same size and are therefore connected to the same electrically conductive track 91. Thereby, it is ensured that all LEDs of the array of LEDs 304 having the same size are, in operation, driven by the same electrical current.

Figure 6:
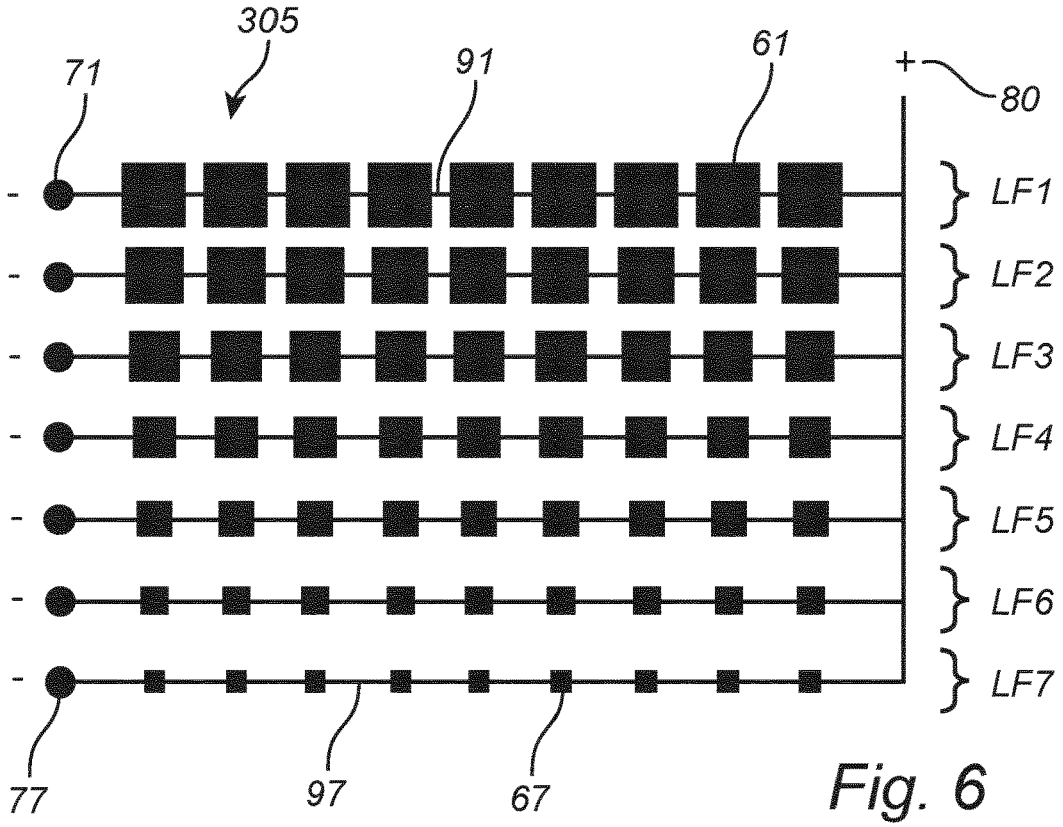
FIG. 6 shows a schematic top view of a fifth embodiment of an array of LEDs of a light emitting device according to the invention and showing another embodiment of electrically conductive tracks powering the LEDs.

FIG. 6 shows a schematic top view of a fifth embodiment of an array of LEDs 305 of a light emitting device 3 according to the invention and another embodiment of electrically conductive tracks 91-97 powering the LEDs. The array of LEDs 305 is identical to that shown in FIG. 5. However, the electrically conductive tracks 91-97 of the plurality of electrically conductive tracks differ from those shown in FIG. 5 in that they comprise a common positive terminal 80 and one negative terminal 71-77 each. LEDs of the array of LEDs 305 having the same size are still connected to the same electrically conductive track of the plurality of electrically conductive tracks 91-97. Thereby, it is ensured that in operation the total luminous flux of the LEDs driven by each electrically conductive track of said plurality of electrically conductive tracks is the same. This in turn enables the provision of the same luminous flux LF in each group of equally sized LEDs, i.e. LF1=LF2= . . . =LF7, which in turn provides for a homogeneous light output.

It is noted that the embodiments shown in FIGS. 5 and 6 and described above could also be envisaged analogously for LEDs of an array of LEDs having the same shape rather than size, or even having the same shape and size.

Figure 7:
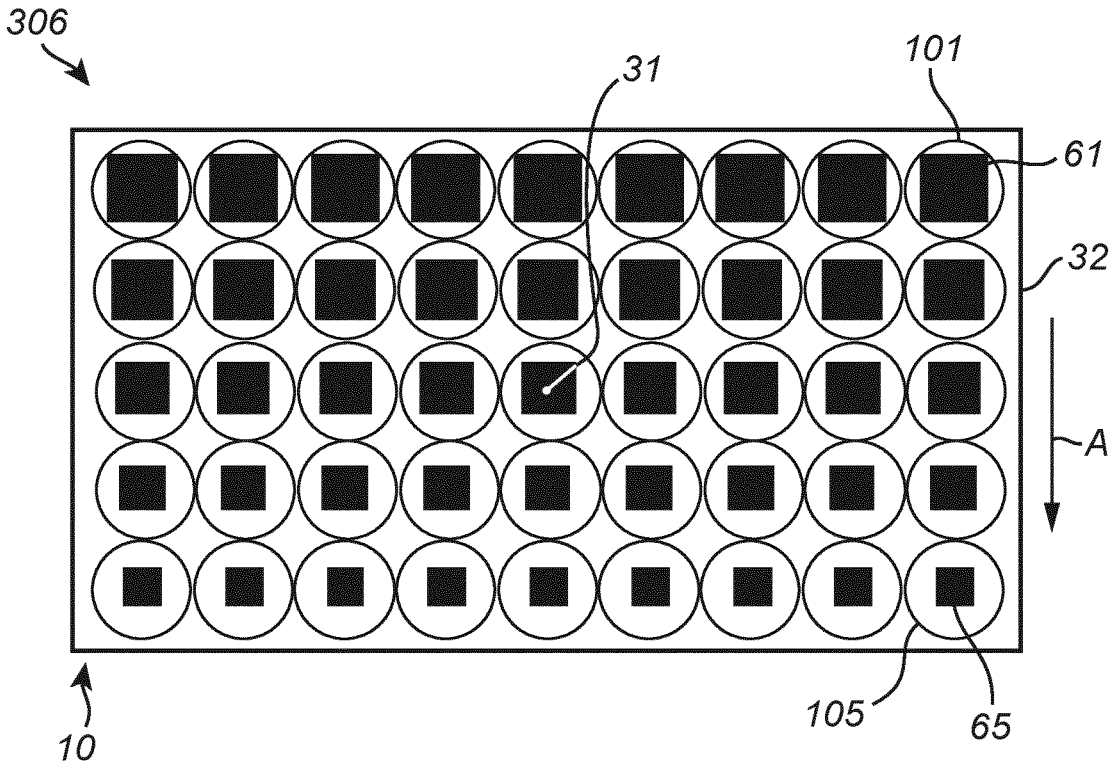
FIG. 7 shows a schematic top view of a sixth embodiment of an array of LEDs of a light emitting device according to the invention and comprising an array of optical elements.

FIG. 7 shows a schematic top view of a sixth embodiment of an array of LEDs 306 of a light emitting device 3 according to the invention. The array of LEDs 306 differs from that described above in relation to FIG. 2 in virtue of the feature that the array of LEDs 306 comprises 9×5 LEDs 61-65.

Furthermore, FIG. 7 shows an embodiment of an array of optical elements 10 with which the light emitting device is provided. Each optical element 101-105 of the array of optical elements 10 is associated with an LED 61-65 of the array of LEDs 306. Generally, and applying irrespective of the embodiment, the respective optical elements of the array of optical elements 10 are configured to enable visibility of the light emitted by that LED of the array of LEDs 306 with which the optical element is associated. Non limiting examples of feasible optical elements include lenses, collimators and total internal reflector (TIR) collimators.

Figure 8:
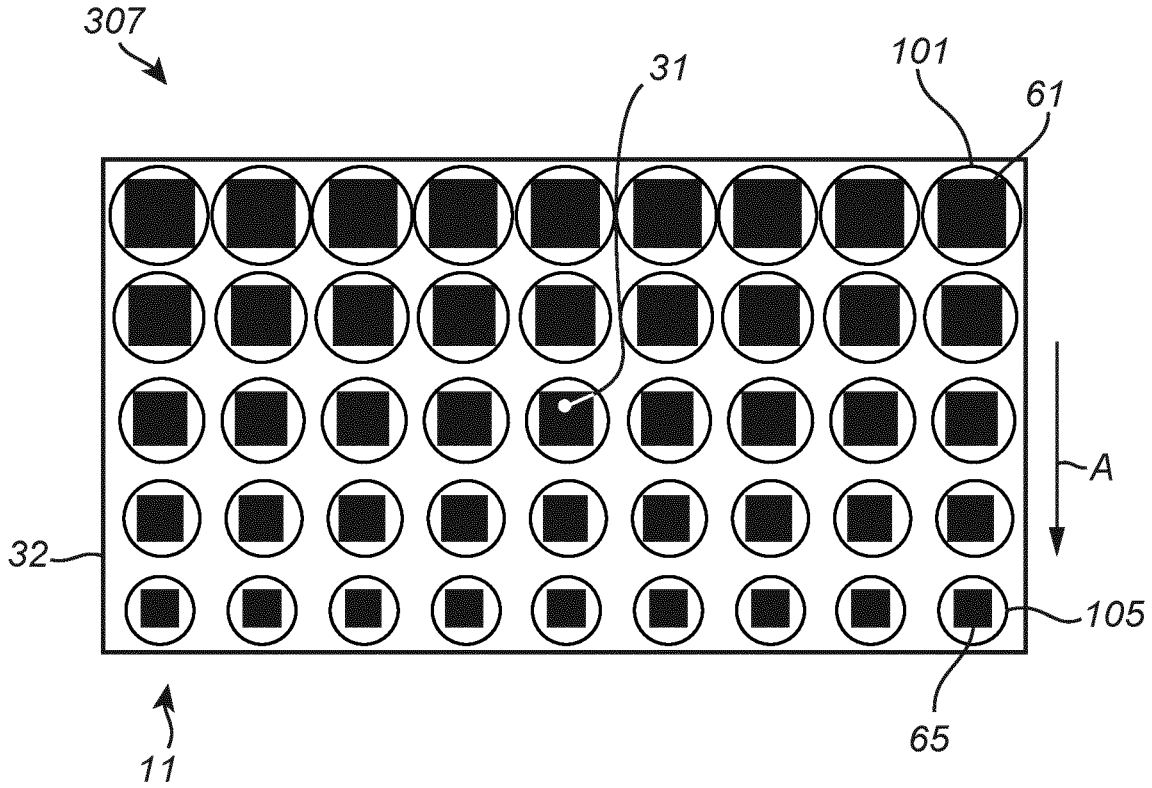
FIG. 8 shows a schematic top view of a seventh embodiment of an array of LEDs of a light emitting device according to the invention and comprising an array of optical elements.

FIG. 8 shows a schematic top view of a seventh embodiment of an array of LEDs 307 of a light emitting device 3 according to the invention and another embodiment of an array of optical elements 11. The array of LEDs 307 is identical to that shown in FIG. 7. However, the size of each optical element 101-105 of the array of optical elements 11 correlates with the size of the LED of the array of LEDs 307 with which the optical element is associated.

Figure 9:
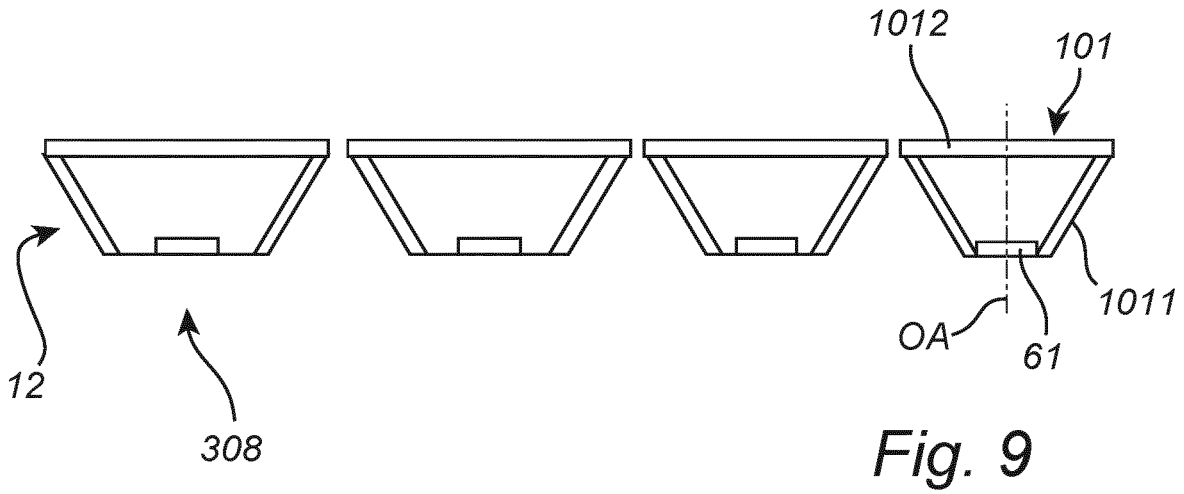
FIG. 9 shows a schematic cross-sectional side view of an eighth embodiment of an array of LEDs of a light emitting device according to the invention and comprising an array of optical elements.

FIG. 9 shows a schematic cross-sectional side view seen along a line L of an eighth embodiment of an array of LEDs 308 of a light emitting device 3 according to the invention and another embodiment of an array of optical elements 12. The optical elements 101 of the array of optical elements 12 differ from those shown in FIGS. 7 and 8 in that the optical elements 101 of the array of optical elements 12 on each line are arranged such that a gradient in size in the direction A of the optical elements is provided. The gradient in size of the optical elements 101-105 may correspond to the gradient in size of the LEDs 61-65.

As may be seen from FIG. 9, each optical element comprises a circumferential side wall 1011 and a light exit surface 1012. The gradient in size may be obtained in that the size of the light exit surface 1012 is changed, for instance as shown in FIG. 9 is decreasing from the left hand side towards the right hand side of FIG. 9. Simultaneously the side wall 1011 may be moved closer to the LED 61 such as to still abut the outer edge of the light exit surface 1012, and/or the side wall 1011 may be arranged with a steeper inclination—or smaller or more acute angle—to the optical axis OA of the optical element 101.

Furthermore, as an observer of a light emitting device with an array of LEDs 308 according to FIG. 9 will perceive the LEDs on each line as having a gradient in size, it is in this embodiment in principle possible to omit providing the LEDs on each line with different physical sizes.

Figure 10:
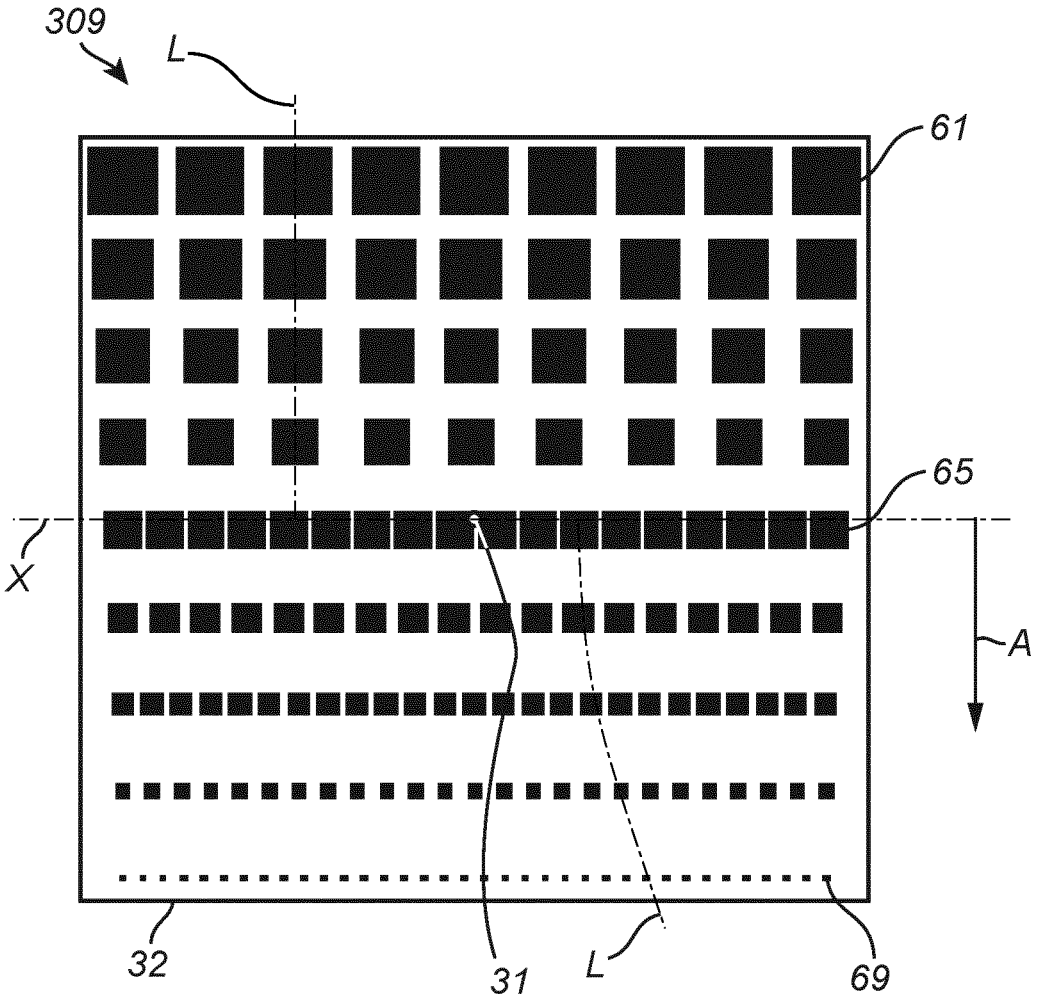
FIG. 10 shows a schematic top view of a ninth embodiment of an array of LEDs of a light emitting device according to the invention.

Turning now to FIG. 10, a schematic top view of a ninth embodiment of an array of LEDs 309 of a light emitting device 3 according to the invention is shown. The array of LEDs 309 differs from those described above in relation to FIGS. 2-9 in virtue of that the number of LEDs with a given size increases as the size of the LEDs decrease. For instance, as shown in FIG. 10 with a non-limiting example, there is nine LEDs 61 in the upper most horizontal row having the largest LEDs, increasing to eighteen LEDs 65 in the middle horizontal row having the fifth largest LEDs and further increasing to thirty-six LEDs 69 in the lower most horizontal row having the smallest LEDs.

It is noted that the embodiment shown in FIG. 10 and described above could also be envisaged analogously for LEDs of an array of LEDs having a decreasing shape rather than size.

Figure 11:
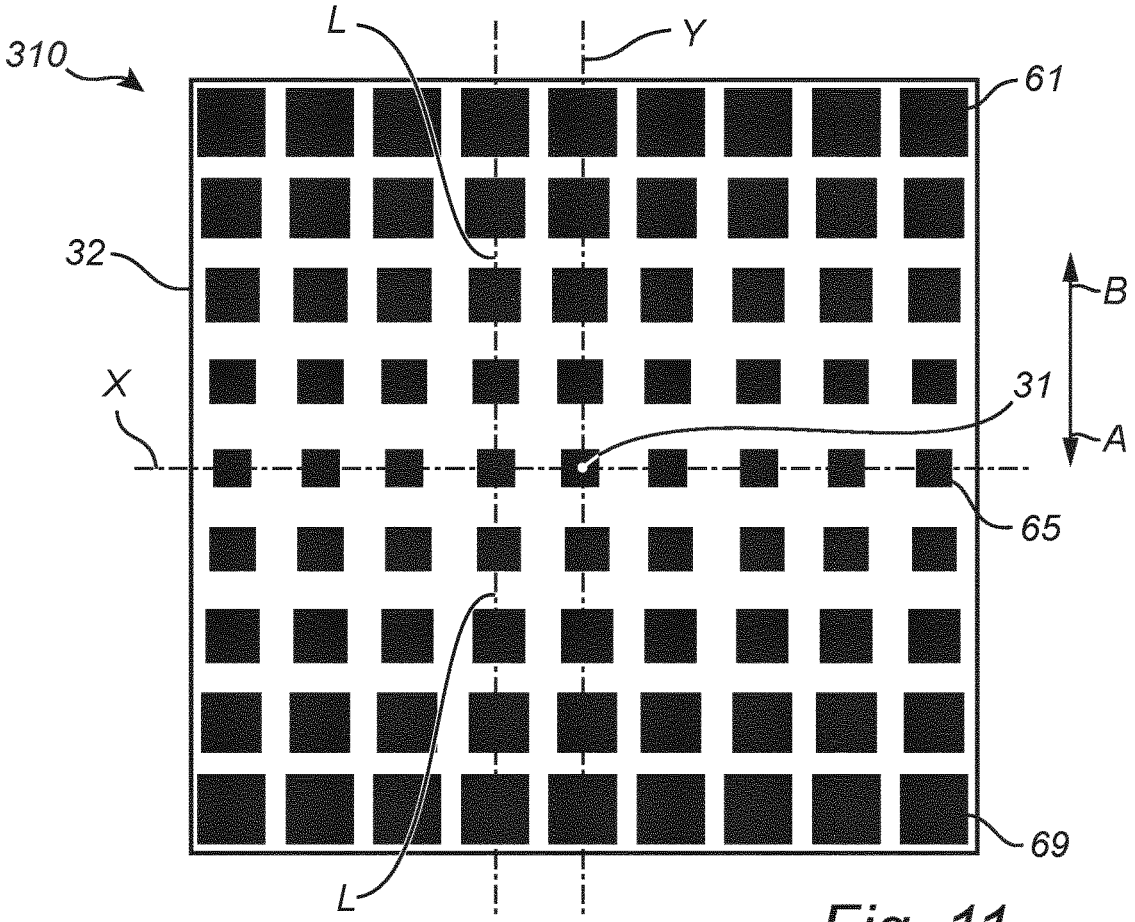
FIG. 11 shows a schematic top view of a tenth embodiment of an array of LEDs of a light emitting device according to the invention.

FIG. 11 shows a schematic top view of a tenth embodiment of an array of LEDs 310 of a light emitting device 3 according to the invention. As shown, a second axis Y is defined as extending transverse, and in some embodiments perpendicular, to the first axis X, through the center 31 and perpendicular to the perimeter 32.

The array of LEDs 310 differs from those described above in relation to FIGS. 2-10 in virtue of that, starting from the upper most line of LEDs 61 and towards the lower most line of LEDs 69, the gradient of the size of the LEDs 61-69 is symmetrical around the second axis Y. Thus, the size of the LEDs 61-69 comprises a gradient in the direction A, such that the size of the LEDs decreases from the LEDs 61 to the LEDs 65 on the second axis Y and increases from the LEDs 65 on the second axis Y to the LEDs 69. Put in other words, the size of the LEDs 61-69 may be seen as having a gradient in two directions, namely both the direction A and the direction B, more particularly such that the size of the LEDs decreases in the direction A from the LEDs 61 to the LEDs 65 on the second axis Y and decreases in the direction B from the LEDs 65 on the second axis Y to the LEDs 69.

Figure 12:
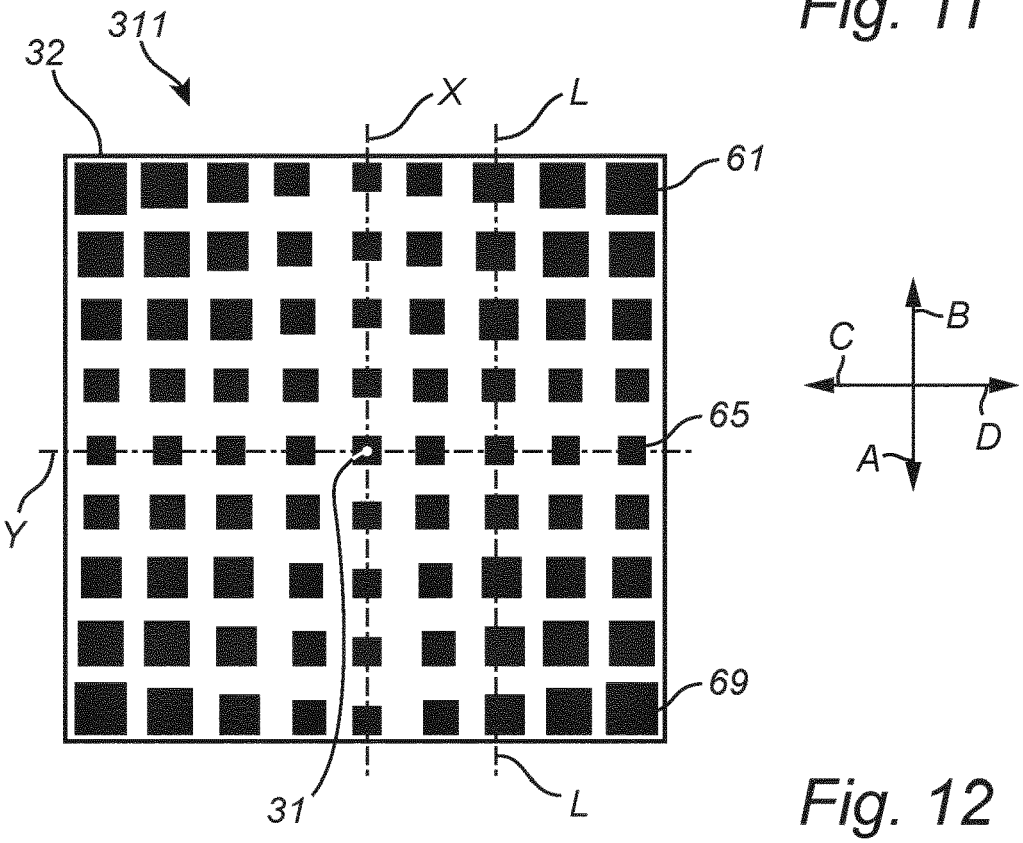
FIG. 12 shows a schematic top view of an eleventh embodiment of an array of LEDs of a light emitting device according to the invention.

FIG. 12 shows a schematic top view of an eleventh embodiment of an array of LEDs 311 of a light emitting device 3 according to the invention. The array of LEDs 311 differs from that described above in relation to FIG. 11 in virtue of that the gradient of the size of the LEDs 61-69 is symmetrical around both the second axis Y and the first axis X. Thus, the size of the LEDs 61-69 comprises a gradient in the direction A, such that the size of the LEDs decreases from the LEDs 61 to the LEDs 65 on the second axis Y and increases from the LEDs 65 on the second axis Y to the LEDs 69, and also comprises a gradient in the direction D, such that the size of the LEDs decreases from the left most LEDs in FIG. 12 to the LEDs on the first axis X and increases from the LEDs on the first axis X to the right most LEDs in FIG. 12. Put in other words, the size of the LEDs of the array of LEDs 311 may be seen as having a gradient in four directions, namely the directions A, B, C and D, and more particularly such that the size of the LEDs decreases in the direction A from the LEDs 61 to the LEDs 65 on the second axis Y and decreases in the direction B from the LEDs 65 on the second axis Y to the LEDs 69, and further such that the size of the LEDs decreases in the direction D from the left most LEDs in FIG. 12 to the LEDs on the first axis X and decreases in the direction C from the LEDs on the first axis X to the right most LEDs in FIG. 12.

Figure 13:
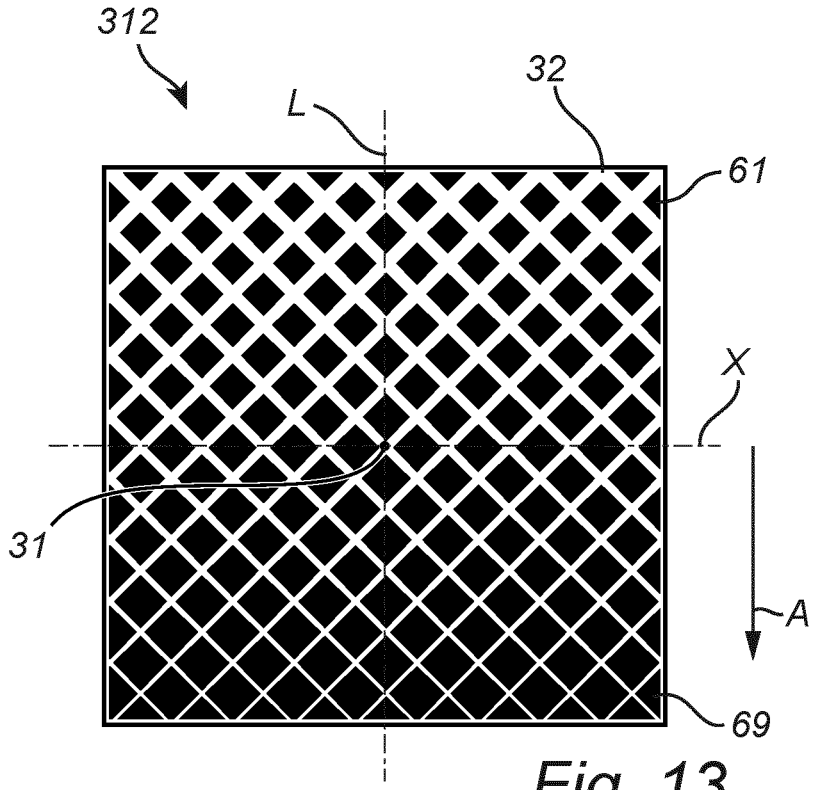
FIG. 13 shows a schematic top view of a twelfth embodiment of an array of LEDs of a light emitting device according to the invention.

FIG. 13 shows a schematic top view of a twelfth embodiment of an array of LEDs 312 of a light emitting device 3 according to the invention. The array of LEDs 312 differs from those described above in relation to FIGS. 2-12 in virtue of that the LEDs 61-69 are tilted 45 degrees around their optical axis. Although the optical axis of the LEDs 61-69 is not shown in FIG. 13, it is noted that it extends in a direction perpendicular to the direction A and to the plane of the array of LEDs 312. Referring to FIG. 9, the optical axis of the LEDs may also be described as coinciding with the optical axis OA of the optical element 101. Furthermore, the LEDs are arranged with a gradient in the form of an increase in size of the LEDs 61-69 in the direction A. The gradient may alternatively or additionally be in the shape of the LEDs.

It is noted that the embodiments shown in each of FIGS. 11-13 and described above could also be envisaged analogously for LEDs of an array of LEDs having a decreasing shape rather than size.

Figure 14:
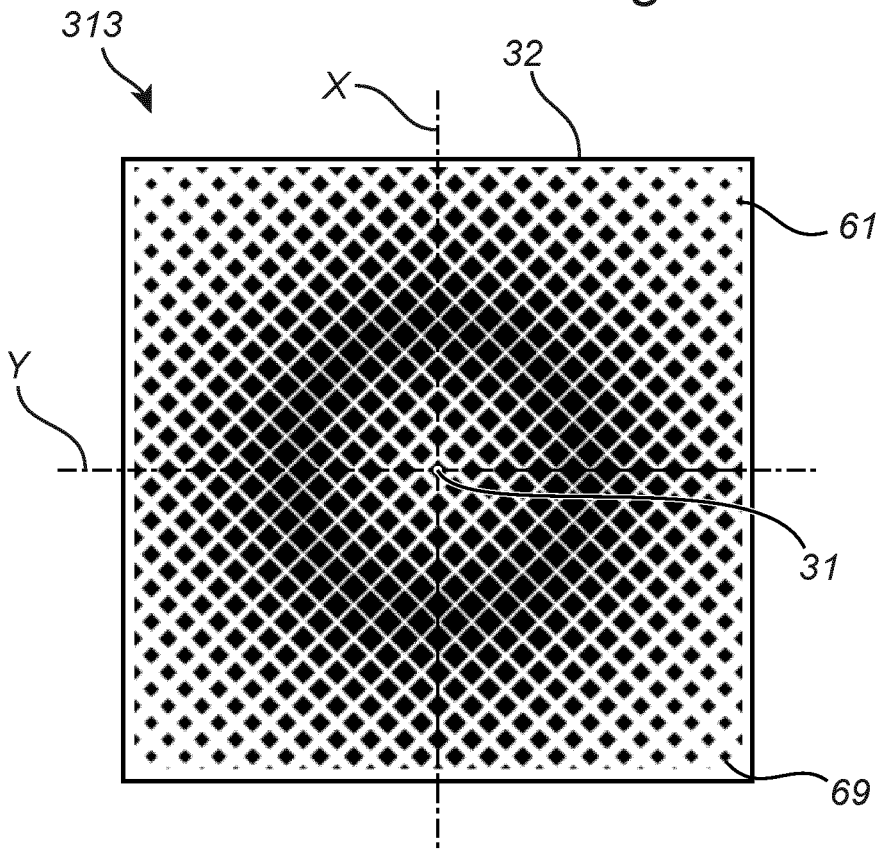
FIG. 14 shows a schematic top view of a thirteenth embodiment of an array of LEDs of a light emitting device according to the invention.

FIG. 14 shows a schematic top view of a thirteenth embodiment of an array of LEDs 313 of a light emitting device 3 according to the invention. The array of LEDs 313 differs from that described above in relation to FIG. 13 in virtue only of that the LEDs 61-69, when seen from the center 31 and towards the perimeter 32 in any direction, are arranged with a gradient in the form of first an increase in the size of the LEDs 61-69 and then a decrease in the size of the LEDs 61-69. The gradient may alternatively or additionally be provided in the shape of the LEDs.

Figure 15:
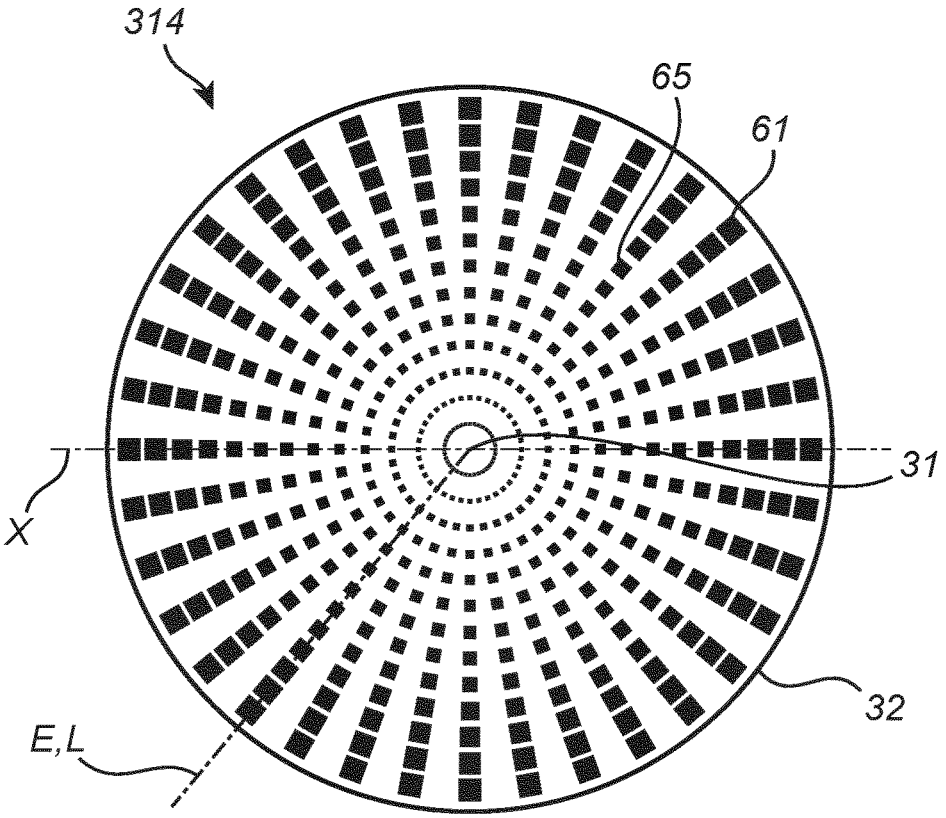
FIG. 15 shows a schematic top view of a fourteenth embodiment of an array of LEDs of a light emitting device according to the invention.

FIG. 15 shows a schematic top view of a fourteenth embodiment of an array of LEDs 314 of a light emitting device 3 according to the invention. The array of LEDs 314 differs from those described above in relation to FIGS. 2-14 in virtue of that it is circular in shape with the LEDs arranged on lines L extending in a radial direction E from the center 31 of the array of LEDs to the circumferential edge 32 of the array of LEDs and with a gradient in the size of the LEDs along the line L. The gradient may alternatively or additionally be provided in the shape of the LEDs.

Figure 16:
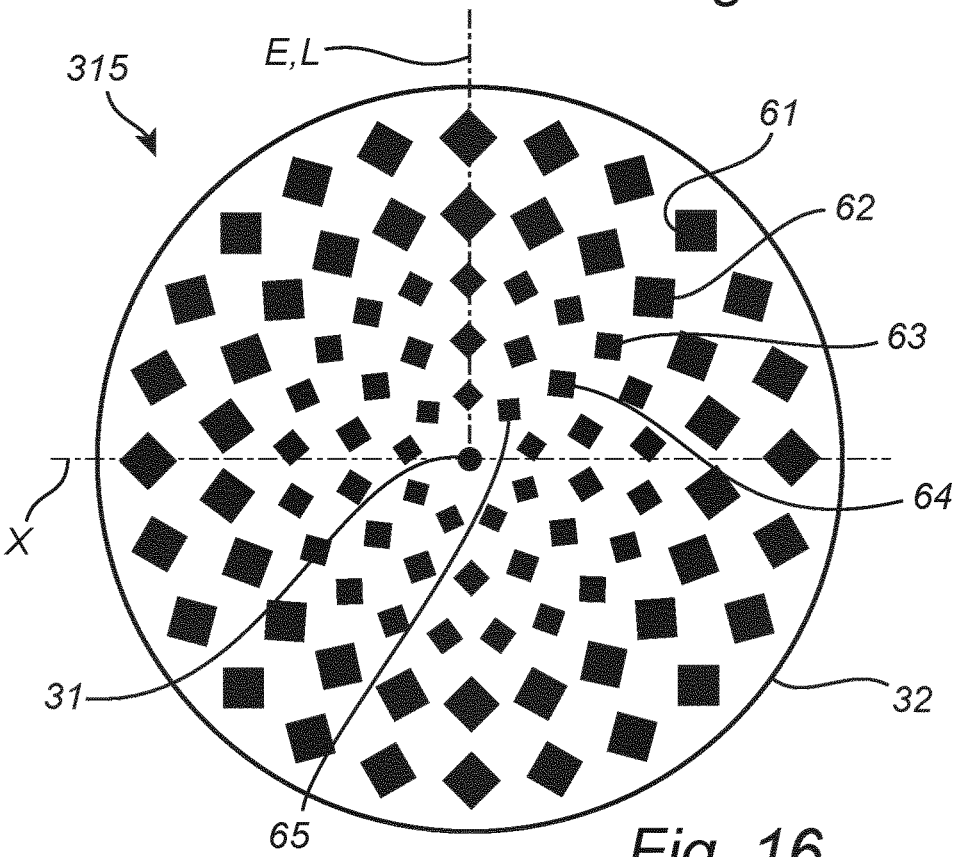
FIG. 16 shows a schematic top view of a fifteenth embodiment of an array of LEDs of a light emitting device according to the invention.

FIG. 16 shows a schematic top view of a fifteenth embodiment of an array of LEDs 315 of a light emitting device 3 according to the invention. The array of LEDs 315 differs from that described above in relation to FIG. 15 only in virtue of that the LEDs 61-69 are tilted 45 degrees around their optical axis.

Figure 17:
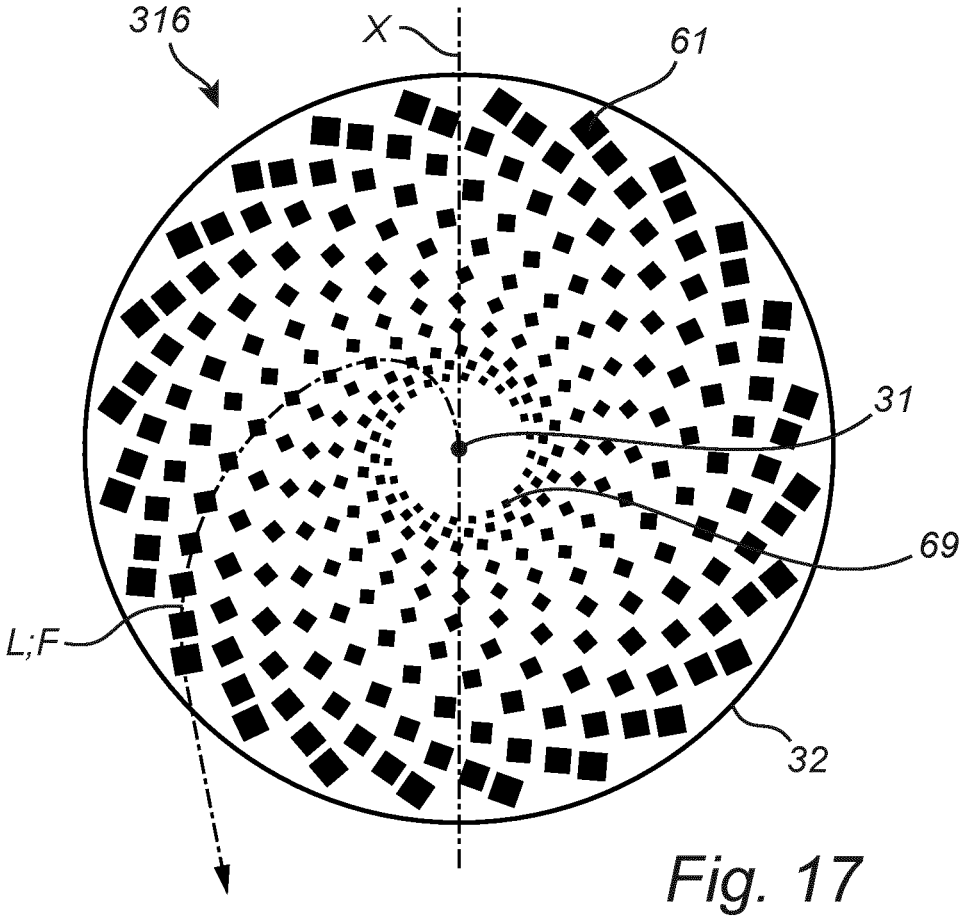
FIG. 17 shows a schematic top view of a sixteenth embodiment of an array of LEDs of a light emitting device according to the invention.

FIG. 17 shows a schematic top view of a sixteenth embodiment of an array of LEDs 316 of a light emitting device 3 according to the invention. The array of LEDs 316 differs from those described above in relation to FIGS. 2-16 in virtue of that the LEDs are arranged in a spiraling pattern. More particularly, the LEDs 61-69 are arranged on lines L extending in a curving or spiraling direction F and with a gradient in the size of the LEDs along the line L. The lines thus extend in the direction F curving from the center 31 of the array of LEDs towards the perimeter 32 of the LEDs. The gradient may alternatively or additionally be provided in the shape of the LEDs.

Figure 18:
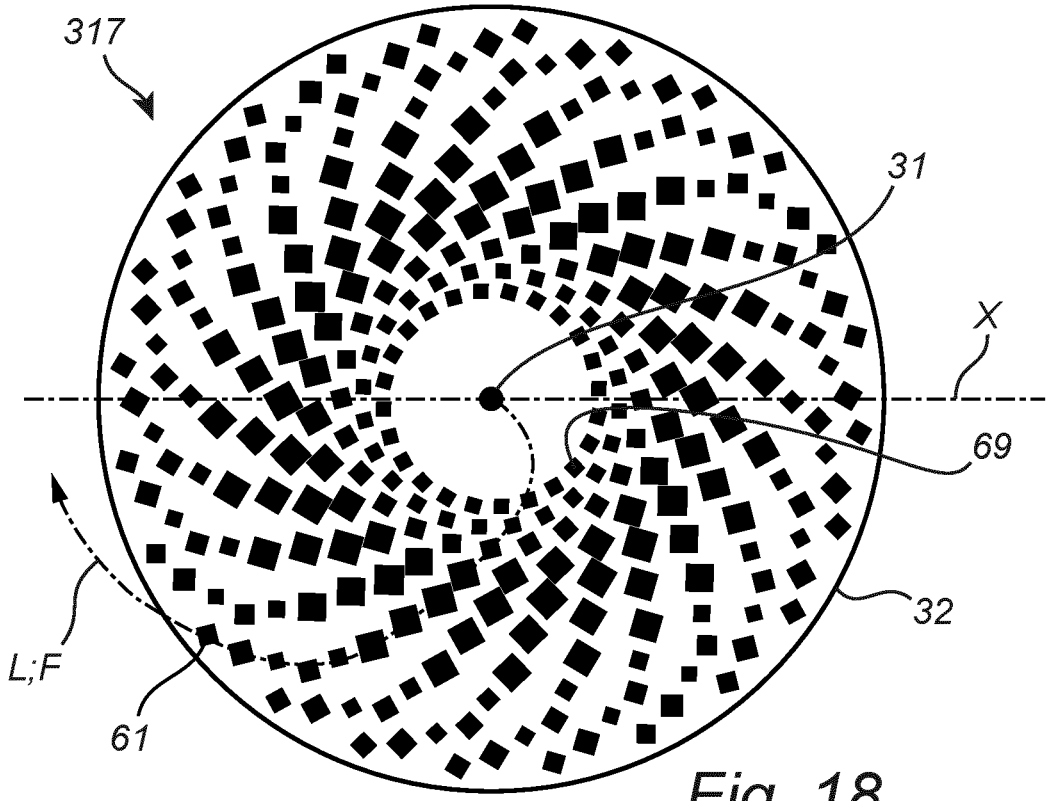
FIG. 18 shows a schematic top view of a seventeenth embodiment of an array of LEDs of a light emitting device according to the invention.

FIG. 18 shows a schematic top view of a seventeenth embodiment of an array of LEDs 317 of a light emitting device 3 according to the invention. The array of LEDs 317 differs from that described above in relation to FIG. 17 in virtue only of that the LEDs 61-69, when seen from the center 31 and towards the perimeter 32 along the line L extending in the curving direction F, are arranged with a gradient in the form of first an increase in the size of the LEDs 61-69 and then a decrease in the size of the LEDs 61-69. The gradient may alternatively or additionally be provided in the shape of the LEDs.

Figure 19:
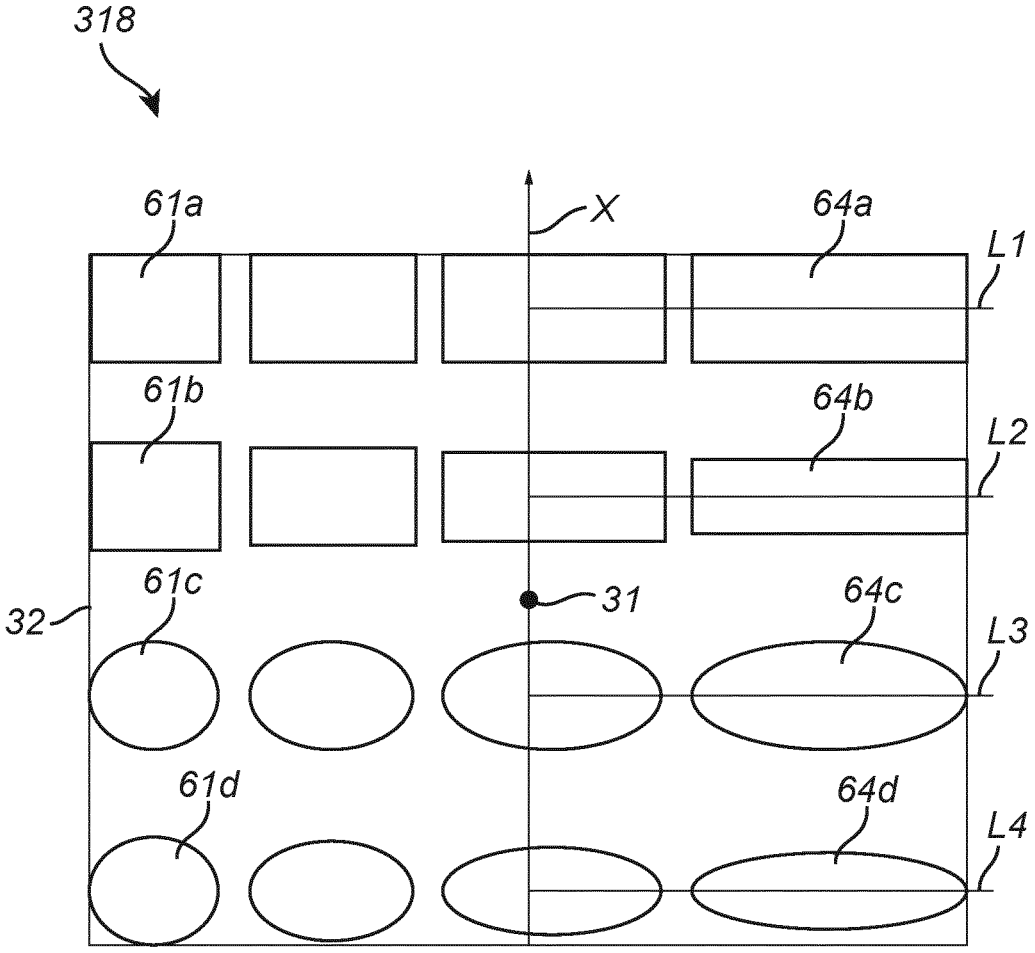
FIG. 19 shows a schematic top view of an eighteenth embodiment of an array of LEDs of a light emitting device according to the invention.

Finally, FIG. 19 shows a schematic top view of an eighteenth embodiment of an array of LEDs 318 of a light emitting device 3 according to the invention. The array of LEDs 318 differs from those described above in relation to FIGS. 2-17 in virtue only of that the gradient in the size of the LEDs is obtained by providing the two or more LEDs on each line L1-L4 with different shapes.

FIG. 19 illustrates four different exemplary ways of obtaining a gradient in the size of the LEDs is obtained by providing the two or more LEDs on each line L1-L4 with different shapes. It is noted that lines L1-L4 of LEDs

61*a*-64*a*, 61*b*-64*b*, 61*c*-64*c* and 61*d*-64*d* according to any one or more of the four different embodiments may be combined in any feasible manner to form an array of LEDs.

The LEDs 61*a*-64*a* arranged on the line L1 are rectangular and are provided with changing shape along the line L1 in such a manner that the length of the LEDs 61*a*-64*a* increases while the width is kept constant.

The LEDs 61*b*-64*b* arranged on the line L2 are rectangular and are provided with changing shape along the line L2 in such a manner that the length of the LEDs 61*b*-64*b* increases while the width decreases.

The LEDs 61*c*-64*c* arranged on the line L3 are oval or elliptic and are provided with changing shape along the line L3 in such a manner that the length measured along the major axis of the LEDs 61*c*-64*c* increases while the width measured along the minor axis is kept constant.

The LEDs 61*d*-64*d* arranged on the line L4 are oval or elliptic and are provided with changing shape along the line L4 in such a manner that the length measured along the major axis of the LEDs 61*d*-64*d* increases while the width measured along the minor axis decreases.

Generally, the LEDs may be square or rectangular or round, such as circular or oval or elliptic. For example, in the case of a COB (Chip on Board), the LEDs are typically round. If rectangular, the aspect ratio (length L to width W) of the LEDs is in the range L=1.1*W to L=2*W.

Also, the following generally applicable embodiments should be noted.

In an embodiment, especially when the array of LEDs is rectangular in shape, the array of LEDs comprises at least 5 rows of LEDs, at least 7 rows of LEDs, at least 8 rows of LEDs, such as for example 10 rows of LEDs.

In an embodiment where the array of LEDs is rectangular in shape, the array of LEDs comprises at least 5 columns of LEDs, at least 7 columns of LEDs, at least 8 columns of LEDs, such as for example 10 rows of LEDs.

In embodiments where the LEDs are arranged in a spiralling pattern, the array of LEDs comprises at least 5 spirals or spiralling lines L of LEDs, at least 7 spirals of LEDs, at least 8 spirals of LEDs, such as for example 10 spirals of LEDs.

In an embodiment, at least 3 neighbouring LEDs have different sizes and/or shapes with a decrease in shape and/or size. In a further embodiment, all rows have at least 3 neighbouring LEDs have a different sizes and/or shapes with a decrease in shape and/or size. In an embodiment, the difference in size is at least 5%, at least 10%, or even at least 20%.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting device comprising:

a two-dimensional rectangular array of light emitting diodes (LEDs), said array of LEDs comprising a plurality of LEDs, a center, a perimeter and a first axis extending in a first direction of the rectangular array through said center, wherein each LED of the two-dimensional array of LEDs comprises a size and a shape, wherein the plurality of LEDs is arranged on a plurality of lines extending in a second direction orthogonally to said first direction from a point on the first axis towards the perimeter, two or more LEDs of the plurality of LEDs being arranged on each line, wherein the two or more LEDs on each line are arranged such that at least one gradient in the size of the LEDs is provided in a direction along each line, and the LEDs on the first axis are the same in size and shape, and wherein each LED of said plurality of LEDs provides a continuous uniform luminance when the light emitting device is in an on state.

2. A light emitting device according to claim 1, wherein the pitch measured as the distance between centers of mutually adjacent LEDs on a line is constant.

3. A light emitting device according to claim 1, wherein the pitch measured as the distance between centers of mutually adjacent LEDs on a line is increasing with a decreasing size of the LEDs.

4. A light emitting device according to claim 1, wherein the at least one gradient in size of the LEDs is an increase, a decrease or a combination of an increase and a decrease, and/or wherein the gradient in the size of the LEDs is obtained by providing the two or more LEDs on each line with different shapes.

5. A light emitting device according to claim 1, wherein the direction in which the lines extend is a linear direction.

6. A light emitting device according to claim 1, and further comprising a plurality of electrically conductive tracks, wherein each electrically conductive track of said plurality of electrically conductive tracks comprise a positive terminal and a negative terminal for connection with a power source, and wherein LEDs of said array of LEDs having the same size are connected to the same one electrically conductive track of said plurality of electrically conductive tracks, and are thus, in operation, driven by the same electrical current.

7. A light emitting device according to claim 1, and further comprising a plurality of electrically conductive tracks, wherein the electrically conductive tracks of the plurality of electrically conductive tracks comprise a common positive terminal and one negative terminal each, and wherein LEDs of said array of LEDs having the same size are connected to the same one electrically conductive track of said plurality of electrically conductive tracks, such that, in operation, the total luminous flux of the LEDs driven by each electrically conductive track of said plurality of electrically conductive tracks is the same.

8. A light emitting device according to claim 1, and further comprising an array of optical elements, wherein each optical element of the array of optical elements is associated with an LED of the array of LEDs, and wherein each optical element of the array of optical elements is configured to enable shaping the light emitted by the LED with which the optical element is associated.

9. A light emitting device according to claim 8, wherein each optical element of the array of optical elements has a size, and, wherein a second axis is defined as extending perpendicular to the first axis, through said center and transverse to said perimeter, and wherein the at least one gradient in the size of the LEDs, and where appropriate the size of the optical elements, is symmetrical around at least one of the first axis and the second axis.

10. A light emitting device according to claim 9, wherein the at least one gradient in the size of the LEDs, and where appropriate the size of the optical elements, furthermore is symmetrical around both the first axis and the second axis.

11. A light emitting device according to claim 1, and further comprising an array of optical elements, wherein each optical element of the array of optical elements is associated with an LED of the array of LEDs, and wherein the size of each optical element of the array of optical elements is configured to correlate with the size of the LED with which the optical element is associated.

12. A light emitting device according to claim 1, wherein the light emitting device further comprises an array of optical elements, wherein each optical element of the array of optical elements is associated with an LED of the array of LEDs, and wherein the optical elements of the array of optical elements on each line are arranged such that at least one gradient in size of the optical elements is provided.

13. A light emitting device according to claim 1, wherein the number of LEDs increases with decreasing size of the LEDs.

14. A light emitting device according to claim 1, wherein the lines of LEDs of the array of LEDs are arranged in a quadratic configuration, a rectangular configuration, and/or wherein the LEDs of the array of LEDs are tilted around their optical axis.

15. A lamp, a luminaire or a lighting fixture comprising a light emitting device according to claim 1.

* * * * *